United States Patent [19]

Mitsuhashi

[11] 4,294,153

[45] Oct. 13, 1981

[54] METHOD OF SYNTHESIZING MUSICAL TONES

[75] Inventor: Yasuhiro Mitsuhashi, Hamamatsu, Japan

[73] Assignee: Nippon Gakki Seizo Kabushiki Kaisha, Hamamatsu, Japan

[21] Appl. No.: 77,341

[22] Filed: Sep. 20, 1979

[30] Foreign Application Priority Data

Sep. 26, 1978 [JP] Japan ..... 53/118398

[51] Int. Cl.[3] ..... G10H 1/043

[52] U.S. Cl. ..... 84/1.01; 84/1.24

[58] Field of Search ..... 84/1.01, 1.22, 1.24, 84/1.25

[56] References Cited

U.S. PATENT DOCUMENTS 4,018,121 4/1977 Chowning ..... 84/1.01

4,127,047 11/1978 Tomisawa ..... 84/1.01

4,142,432 3/1979 Kameyama et al. ..... 84/1.01

OTHER PUBLICATIONS

Alley & Atwood, Electronic Engineering, Second Edition, John Wiley & Sons, Inc. New York, London, Sydney, ©1962, 1966, Library of Congress Catalog Card Number:66-16128, pp. 538-541.

*Primary Examiner*—S. J. Witkowski

*Attorney, Agent, or Firm*—Frishauf, Holtz, Goodman & Woodward

[57] ABSTRACT

A method of synthesizing a musical sound in which a fundamental waveform signal is produced which has a zero crossing point within one cycle period thereof and the phase of the zero crossing point is modulated by a modulation signal to provide a musical tone with a complex waveshape.

7 Claims, 34 Drawing Figures

METHOD OF SYNTHESIZING MUSICAL TONES

BACKGROUND OF THE INVENTION

This invention relates to a method of synthesizing musical tones.

A musical tone or natural tone produced by an acoustic or natural musical instrument can be expressed by a Fourier series expansion as shown below $$F(\omega t) = \sum_{n=1}^{N} a_n(t) \cdot \sin(n\omega t + \phi n) \quad (1)$$

where $a_n(t)$ denotes an envelope function of an n-th harmonic component varying with time, $\phi n$ the phase of the n-th harmonic component, $\omega$ the angular frequency of a fundamental tone, and N the number of partial frequency components included in the musical tone.

As will be evident from equation (1), the amplitudes of spectral components composing a musical tone vary independently with time. That is, a natural tone or actual musical instrument tone is characterized by a dynamic audio spectrum.

The simulation of a natural tone with the dynamic audio spectrum can be electronically realized by the use of N envelope function generation circuits, N multipliers and N sinusoidal signal generation circuits. However, since the value of N is relatively large, the actual realization is very difficult.

In an existing music synthesizer, a cut-off frequency or frequencies of a voltage-controlled filter is controlled or modulated by a control waveform having a desired shape. The cut-off frequency control of the voltage-controlled filter, however, only vary a frequency range over which higher harmonic components are distributed, and the frequency spectrum of a musical tone being produced substantially remains unchanged. With the music synthesizer it is considerably difficult to obtain dynamic audio spectra.

SUMMARY OF THE INVENTION

It is an object of this invention to provide a method of synthesizing musical tones with complex waveshapes and dynamic audio spectra.

In accordance with this invention a fundamental waveform signal is produced which has a zero crossing point or variable parameter within one cycle period thereof, and the zero crossing point is modulated by a modulation signal.

DESCRIPTION OF THE PREFERRED EMBODIMENTS

Figure 1:
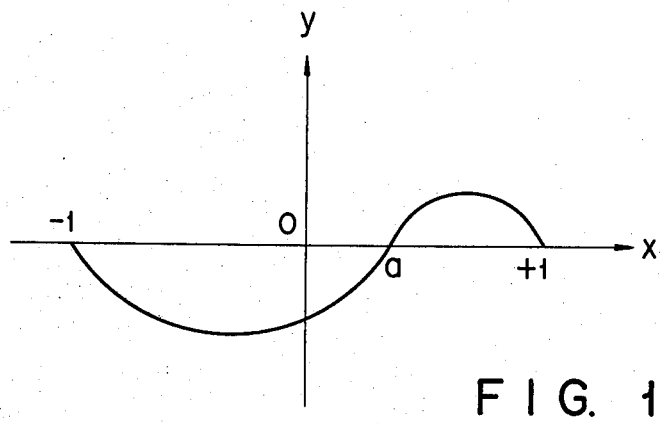
FIG. 1 shows an example of a fundamental waveform or carrier waveform used in this invention.

FIG. 1 shows a fundamental signal y=f(a, x) for forming a musical tone signal and having a sinusoidal wave-like waveform which crosses an axis representing zero amplitude. An oscillation of the fundamental signal during one cycle period occurs between x=1 and x=−1 as shown. The one cycle period of the fundamental signal corresponds to that of a musical tone signal to be produced. With the zero crossing point a at which the signal waveform crosses the zero value of the function during the one cycle period, the waveform of the fundamental signal is expressed as follows:

$$-1 \leqq x < a \quad (2)$$
$$y_1 = (x+1)(x-a)$$
$$a \leqq x < 1 \quad (3)$$
$$y_2 = -(x-a)(x-1)$$

Namely, the fundamental signal is comprised of two quadratic curves or parabolas so as to approximate a sinusoidal wave.

The first derivatives of the functions $y_1$ and $y_2$ at x=a are $y_1'=a+1$ and $y_2'=1-a$, respectively. Accordingly, the waveshape of FIG. 1 is discontinuous at the zero crossing point a, and thus the fundamental signal includes a relatively large number of higher harmonic components.

Figure 2:
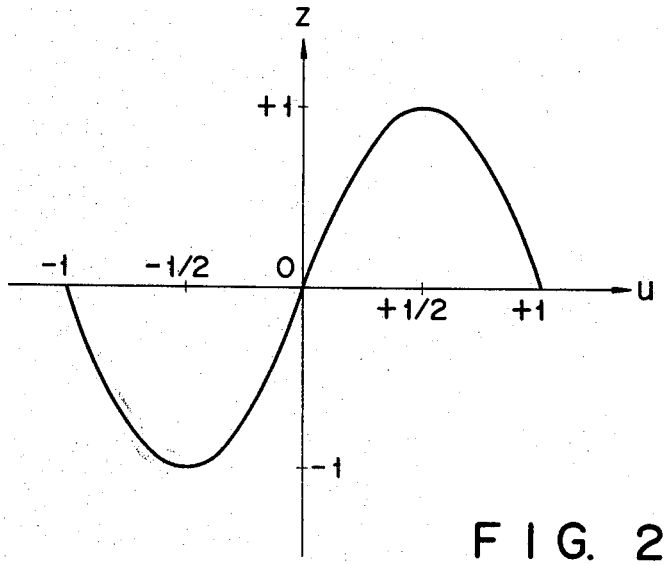
FIG. 2 shows an example of a modulation waveform used to modulate a parameter or zero crossing point of the carrier waveform of FIG. 1.

The phase of the zero crossing point a of the fundamental signal of FIG. 1 is modulated by a modulation function Z=g(u) as shown in FIG. 2. The modulation function Z=g(u) is expressed as follows $$-1 \leqq a < 0 \quad (4)$$
$$Z_1 = g(u) = 4u(u+1)$$
$$0 \leqq u < 1 \quad (5)$$
$$Z_2 = g(u) = -4u(u-1)$$

The relation between the parameter a of the carrier function y=f(a, x) and the modulation function Z=g(u) is given by $$a = I \cdot g(u) \quad (6)$$

where I represents a modulation index.

Therefore y=f(a, x) is expressed by $$y = f(a, x) = f(I \cdot g(u), x) \quad (7)$$

If x and u are replaced by functions of time, then the modulated signal is obtained which is a function of time.

Where the fundamental frequency of a musical tone signal to be produced is f, x and u may be replaced by functions of time as follows:

$$x = 2nft, \; u = 2mft$$

where n and m are constants. nf and mf represent a carrier frequency and modulation frequency, respectively. If the ratio n/m is a rational number, then the modulated output has a periodic waveform. On the other hand, if the ratio n/m is an irrational number, then the modulated output has a nonperiodic waveform. The harmonic structure of the modulated output is determined by the value of modulation index I.

Different values of the modulation index I provide different waveforms, or different frequency spectra. Accordingly, if the modulation index I is caused to vary with time, then a dynamic audio spectra will be realized.

The waveform expressed by equations (2) and (3) is discontinuous at the zero crossing point a as described above, and thus contains a relatively large number of higher harmonic components. In order to simulate a flute-like tone, for example, which has a relatively small number of higher harmonic components, it is desired to use a fundamental waveform having fewer higher harmonic components. To this end, a fundamental waveform which is continuous at the zero crossing point a needs only to be used.

The fundamental waveform which is continuous at the zero crossing point a is expressed as follows:

$$-1 \leqq x < a \qquad (8)$$
$$y_1 = f(a, x) = (x + 1)(x - a)(1 - a)$$
$$a \leqq x < 1 \qquad (9)$$
$$y_2 = f(a, x) = -(x - 1)(x - a)(1 + a)$$

Figure 3:
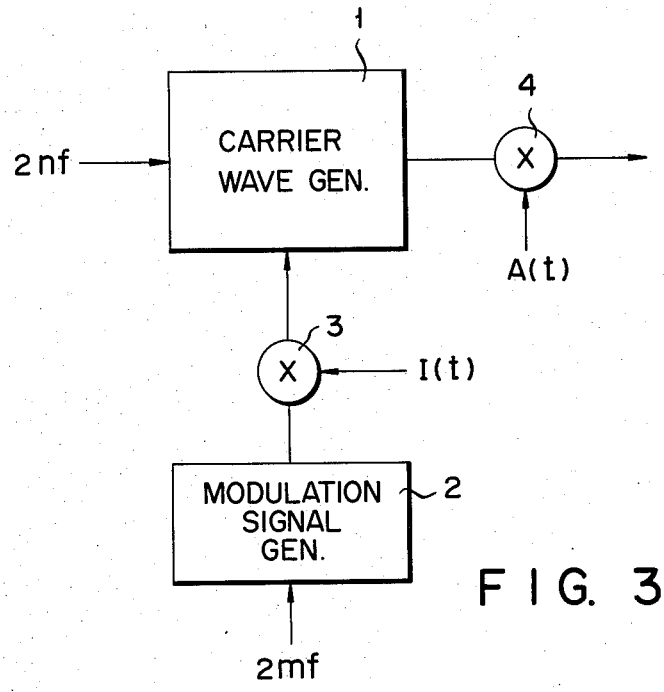
FIG. 3 shows a schematic block diagram for synthesizing a musical tone in accordance with this invention.

The method of this invention for synthesizing musical tones by modulating a parameter or zero crossing point a of the fundamental signal with a modulation function can be easily implemented by a digital method. FIG. 3 shows a basic block diagram for synthesizing musical tones in accordance with this invention. In FIG. 3, reference numeral 1 designates a carrier wave generator for producing a carrier wave of a frequency of nf in response to application of frequency information 2nf thereto. The carrier wave has a controllable parameter a. Frequency information 2mf is applied to a modulation signal generator 2 to produce a modulation signal of a frequency of mf. The modulation signal is multiplied in a multiplier 3 by a value of a modulation index signal I(t) which is a function of time, and then applied to the carrier wave generator 1. The carrier wave generator 1 produces periodically a sinusoidal wave-like carrier signal having such a waveform during one cycle period as represented by $x(x+1)$ and $-x(x-1)$ when no modulation signal is applied thereto, and periodically produces a complex waveform as a result of parameter modulation when the modulation signal is applied thereto. A parameter-modulated carrier signal from the carrier wave generator 1 is multiplied in a multiplier 4 by a value of an envelope function A(t) to change the amplitude of a musical tone signal being produced with time.

Figure 4:
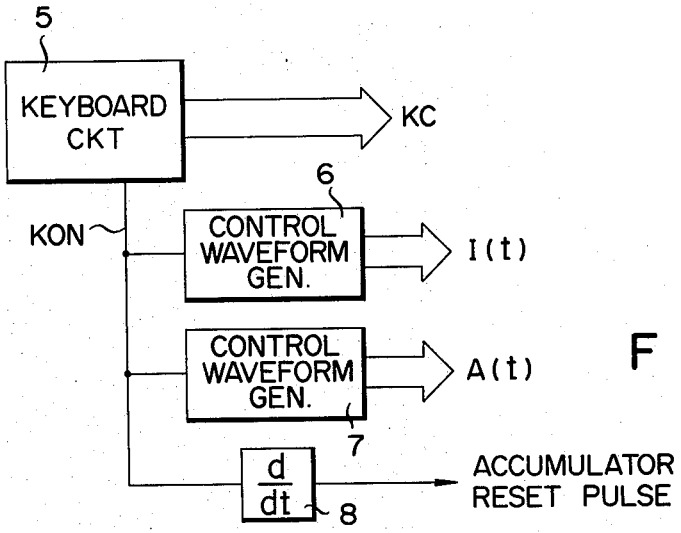
FIG. 4 shows a keyboard circuit section in an electronic musical instrument according to an embodiment of this invention.

The method of this invention can be implemented in an electronic musical instrument. As shown in FIG. 4, a keyboard circuit 5 is arranged so as to produce, in response to depression of a key, a key code signal indicative of the note of the key being depressed and a key-on signal KON indicative of key depression and having a certain magnitude of voltage during a period from key depression to key release. The key code signal KC is applied to a frequency memory described later. The key-on signal KON is applied to control waveform generators 6 and 7 to produce a modulation index digital signal I(t) and amplitude envelope control digital signal A(t) each preferably having an attack portion, steady state portion and decay portion. The digital value of each of I(t) and A(t) increases during the period of the attack portion and decreases during the period of the decay portion. The key-on signal KON is also applied to a differentiator 8 to produce a reset pulse for accumulators as described later.

Figure 5:
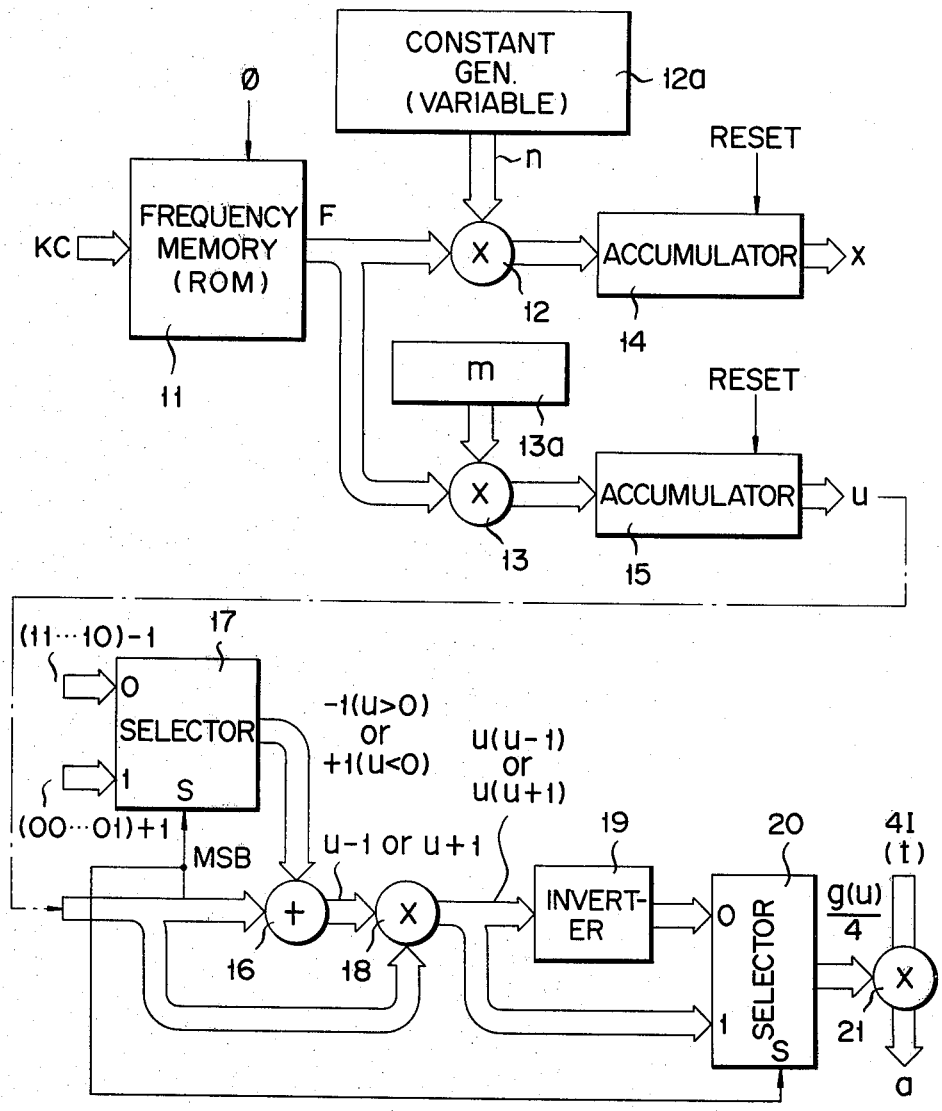
FIGS. 5 and 6 show an arrangement for synthesizing musical tones in accordance with this invention.

Now referring to FIG. 5, the key code signal KC is applied to a frequency memory (ROM) 11 which stores digital frequency information related to the note of each of keys on the keyboard. The frequency memory 11 is accessed by the key code signal KC, and frequency information F corresponding to the note of a key represented by the key code signal KC is periodically read out of the memory 11 by a clock pulse $\phi$ applied thereto at each cycle period of the clock pulse $\phi$. The read-out frequency information F is applied to multipliers 12 and 13. In the multiplier 12, the frequency information F is multiplied by a binary number constant n from a constant generator 12*a* and in the multiplier 13, on the other hand, the frequency information F is multiplied by a binary number constant m from a constant generator 13*a*. The output F×n of the multiplier 12 defines a carrier frequency or one cycle period of a musical tone to be produced. Accordingly, the constant n may be caused to periodically vary so that a vibrato effect is realized in which the carrier frequency periodically varies. The output signals of the multipliers 12 and 13 are respectively applied to accumulators 14 and 15 which are reset upon depressing a key on the keyboard. The accumulators 14 and 15 each accumulate input signals periodically applied thereto and have its output value returned to an initial value (000 . . . 0) when the output value reaches the maximum value (111 . . . 1). The accumulator 14 produces output information x=nFt=2nft which designates one cycle period of the carrier signal, and the accumulator 15 produces output information u=mFt=2mft which designates one cycle period of the modulation signal.

The output u of the accumulator 15 is applied to an adder 16 where it is added to information −1(=111 . . . 10) or +1(=000 . . . 01) from a selector 17 to produce information (u−1) or (u+1). The selector 17 is controlled by MSB (most significant bit) of the output u of the accumulator 15 so as to apply −1 to the adder 16 when the MSB is 0, that is, when the output u is positive and +1 to the adder 16 when the MSB is 1, that is, when the output u is negative. The output (u−1) or (u+1) of the adder 16 is multiplied in a multiplier 18 by the output u of the accumulator 15 to produce an output $u(u-1)$ or $u(u+1)$. The output of the multiplier 18 is coupled directly and through an inverter 19 to a selector 20. The inverter 19 is adapted to invert the sign of input information by converting 0s and 1s in the input information to 1s and 0s, respectively. Like the selector 17, the selector 20 is controlled by the MSB of the output u of the accumulator 15 so that the output of the inverter 19 is selected when the MSB is 0 and, on the other hand, the output of, the multiplier 18 is selected when the MSB is 1. Accordingly, the output of the selector 20 is equal to the modulation function g(u) divided by a factor of 4 as expressed by equations (4) and (5). The output g(u)/4 of the selector 20 is multiplied by the modulation index signal 4I(t) in a multiplier 21 to produce the parameter signal a.

Figure 6:
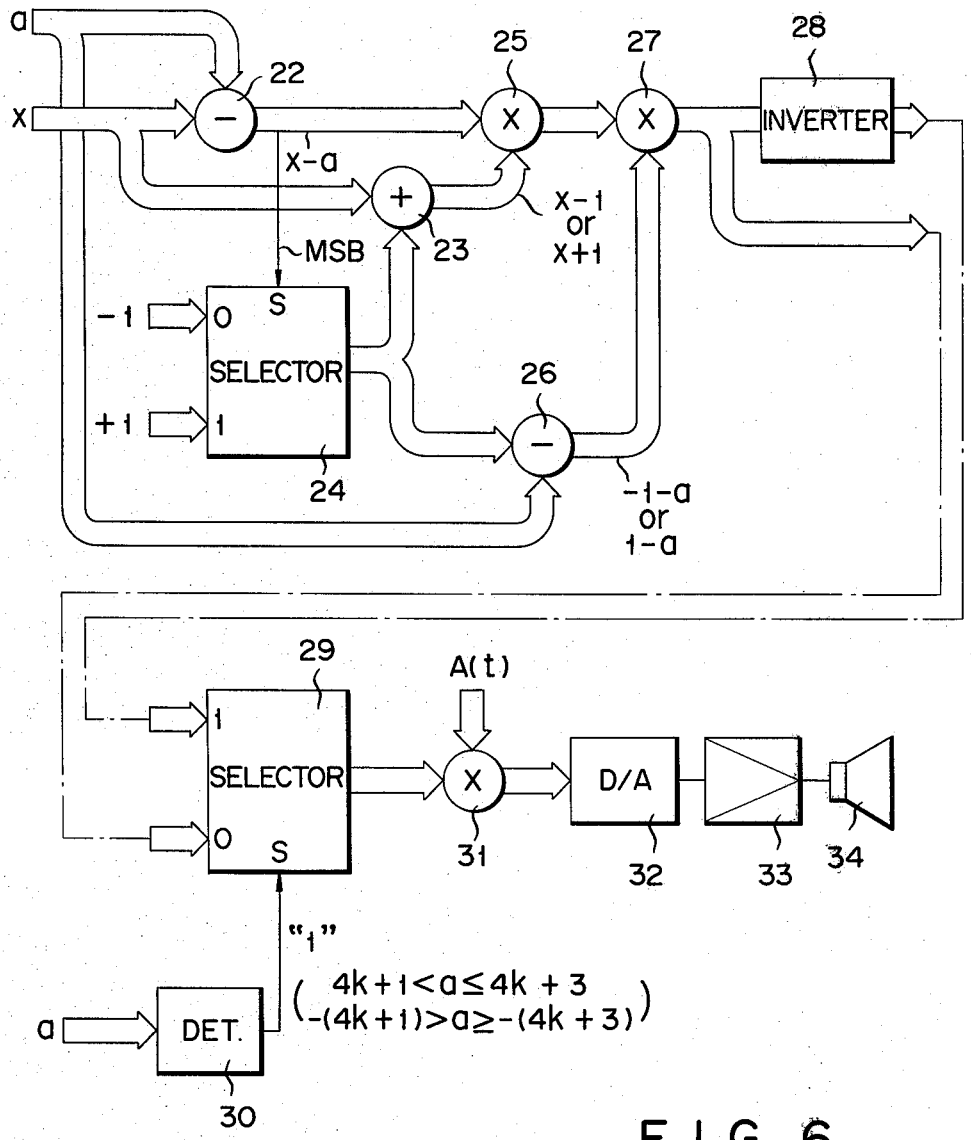

The information x and a obtained in this way are utilized to constitute the function shown in equations (8) and (9). Namely, as shown in FIG. 6, an arithmetic operation of (x−a) is performed in a substractor 22. The information x is added in the adder 23 with −1 or +1 from a selector 24 to produce an output (x−1) or (x+1). The selector 24 is controlled by MSB of the output (x−a) of the subtractor 22 so as to feed −1 to the adder 23 when (x−a) is positive, that is, when the MSB of (x−a) is 0, or +1 to the adder 23 when (x−a) is negative, that is, when the MSB of (x−a) is 1. In a multiplier 25, the output (x−a) of the subtractor 22 is multiplied by the output (x−1) or (x+1) of the adder 23 to produce an output $(x-a)(x-1)$ or $(x-a)(x+1)$. The output of the selector 24 and the parameter information a are applied to the subtractor 26 to form information (−1−a) or (1−a). The output of the multiplier 25 is multiplied by the output of the subtractor 26 to produce an output $-(x-a)(x-1)(1+a)$ or $(x-a)(x+1)(1-a)$.

The output of the multiplier 27 is coupled directly and through an inverter 28 to a selector 29 which is controlled by an output of a detector 30 which detects a value of the parameter information a. The value of the parameter information a may exceed +1 or −1 due to multiplication of the parameter a by the modulation index I. When the value of the parameter a satisfies a relation $4k+1<a\leqq 4k+3$ or $-(4k+1)>a\geqq -(4k+3)$ where k=0,1,2 . . . , the detector 30 produces an output of 1. When the output of the detector is 1 the selector 29 feeds the output signal of the inverter 28 to a multiplier 31. When the output of the detector 30 is 0, on the other hand, the selector 29 feeds the output signal of the multiplier 27 to the multiplier 31.

For example, when the value of the parameter changes from +1 to +1.1 the waveform of a musical tone signal is inverted, leading to an abrupt change in the harmonic structure of a musical tone being synthesized. The inverter 28, selector 29 and detector 30 are provided for ensuring a continuous variation in the harmonic structure corresponding to the continuous variation in the value of parameter a.

In the multiplier 31, the output signal of the selector 29 is multiplied by an envelope function A(t) to produce a musical tone signal. The output tone signal is converted by a digital-to-analog (D/A) converter 32 into an analog tone signal which is applied to an amplifier 33 followed by a loudspeaker 34 for sounding a musical tone.

Figure 7:
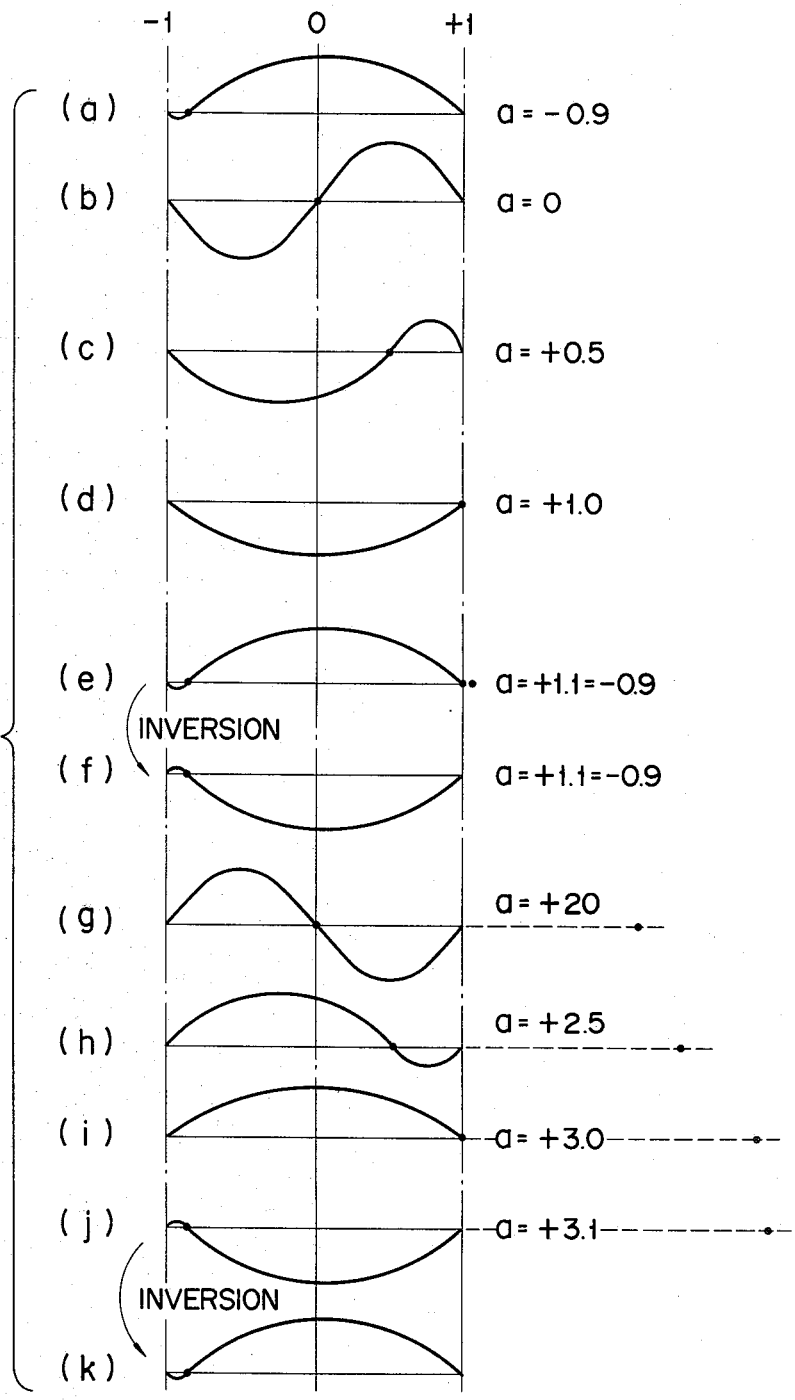
FIGS. 7(*a*)–7(*k*) show waveforms of modulated signals at various values of parameter.

The inversion of the modulated waveform occurring in spite of the continuous variation of the parameter a will be described in more detail with reference to FIG. 8. The modulated waveform varies sequentially as shown in FIG. 7(*a*) to FIG. 7(*d*) according as the parameter a changes sequentially from −1 to +1. When the parameter a becomes +1.1≡−0.9 the modulated waveform becomes identical, as shown in FIG. 7(*e*), to the waveform ata =−0.9 of FIG. 7(*a*). The waveform at a=+1.1 is substantially opposite in polarity to the waveform at a=1 of FIG. 7*d*. This means that when the parameter a exceeds +1, a sudden change in the harmonic structure of a musical tone being produced occurs. This phenomenon is not desirable in music expression. Such a waveform inversion can be avoided by the inverter 28, selector 29 and detector 30 shown in FIG. 6 as described above. Namely, when a=+1.1 the detector 30 produces an output of 1 so that the selector 29 selects the output signal of the inverter 28 as shown in FIG. 7(*f*).

In the range of $1<a\leqq 3$, the modulated signal is derived from the inverter 28 and changes sequentially as shown in FIG. 6(*f*) to FIG. 6(*i*). When the parameter a becomes +3.1, the modulated waveform of the inverter 28 is inverted as shown in FIG. 7(*j*). In the range $3<a\leqq 5$, however, since the output of the detector 30 is 0 the output signal of the multiplier 27 as shown in FIG. 7(*k*) is selected.

The waveform and frequency spectra of musical tone signals synthesized in accordance with the method of this invention will be described hereinafter.

Figure 8A:
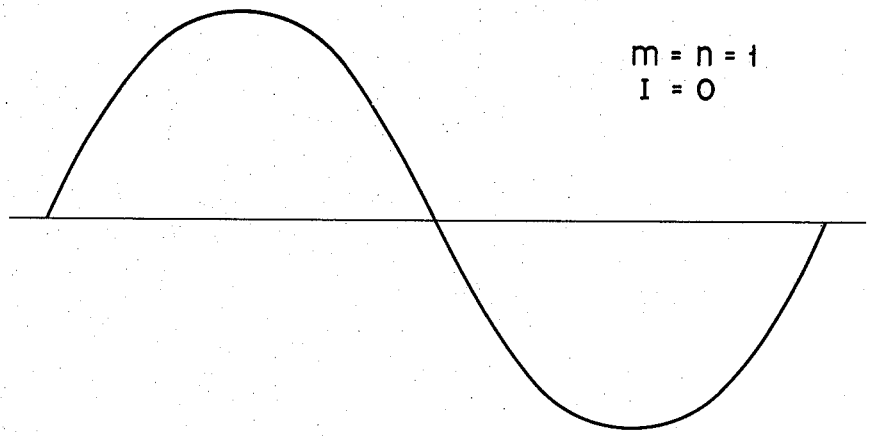
FIGS. 8A, 9A, 10A, 11A, 12A and 13A show waveforms of musical tone signals synthesized in accordance with this invention.
Figure 8B:
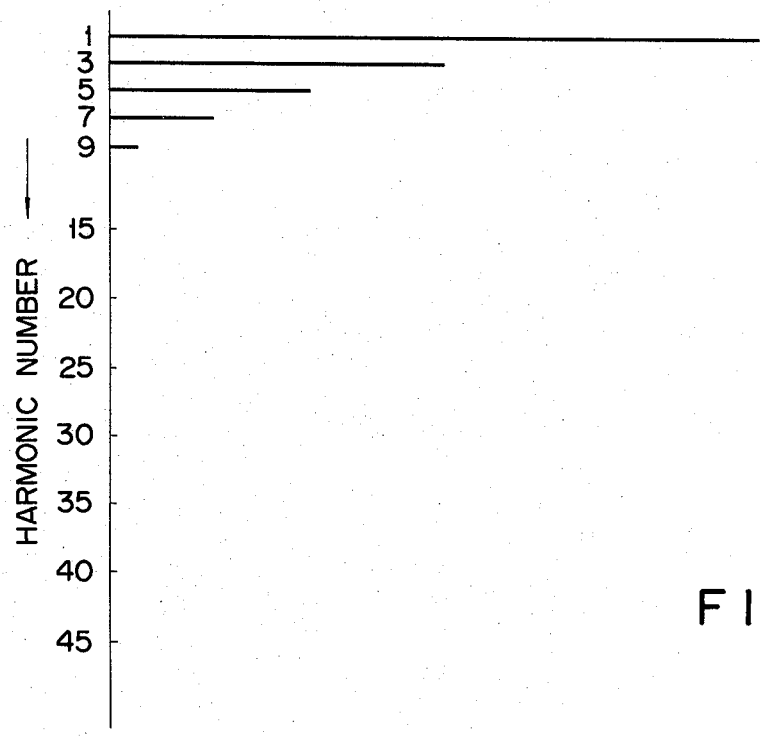
FIGS. 8B, 9B, 10B, 11B, 12B and 13B show frequency spectra of the musical tone signals shown in FIGS. 8A through 13A, respectively.

FIG. 8A shows a one cycle waveform of a musical tone signal synthesized under a state of m=n=1 and modulation index I=0. The frequency spectrum of the musical tone signal is shown in FIG. 8B. The musical tone signal has a relatively small number of harmonic components and thus simulates a flute-like tone.

Figure 9A:
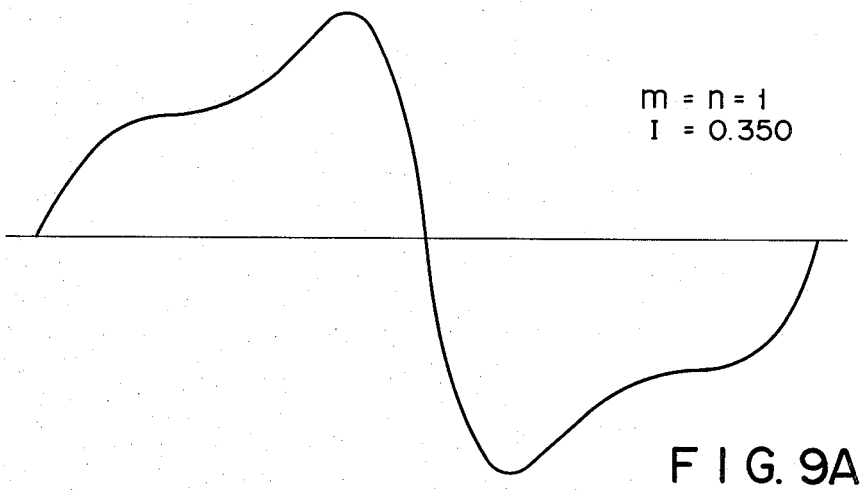

Under a condition m=n=1 and I=0.350, since the parameter a varies periodically the waveform of synthesized musical tone signal becomes as shown in FIG. 9A. As will be evident from the frequency spectrum shown in FIG. 9B, the musical tone signal contains more harmonic components than in the case of I=0 and simulates a flute-like tone more effectively.

Figure 10A:
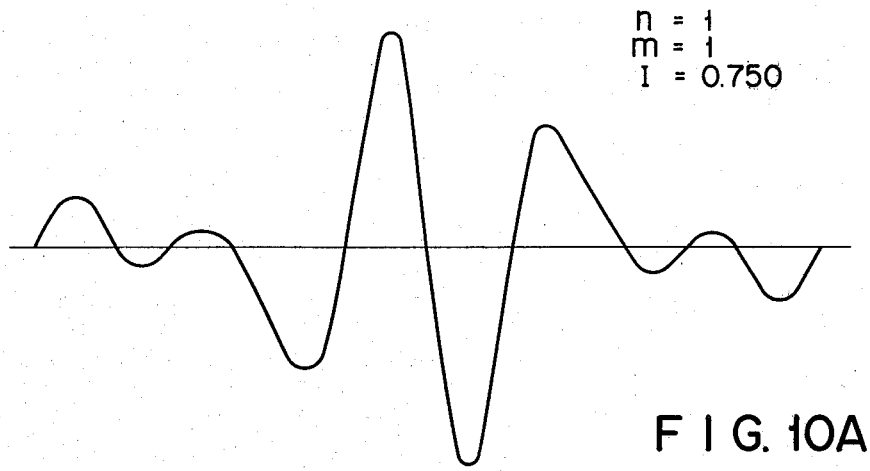
Figure 10B:
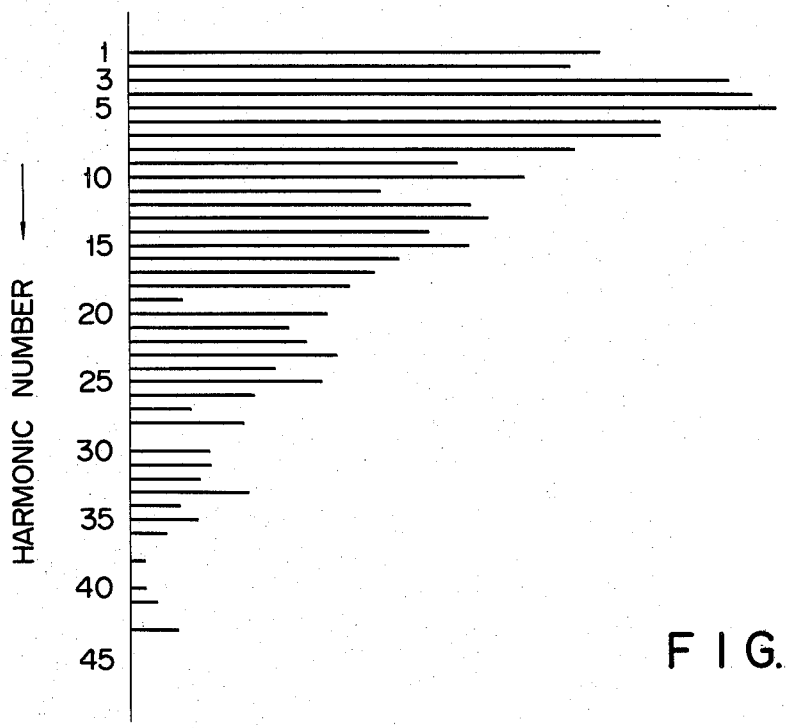

Under a state m=n=1 and I=0.750 a musical tone signal is synthesized which has a waveform as shown in FIG. 10A and a frequency spectrum as shown in FIG. 10B. This musical tone signal is used to simulate a French horn-like tone.

Figure 9B:
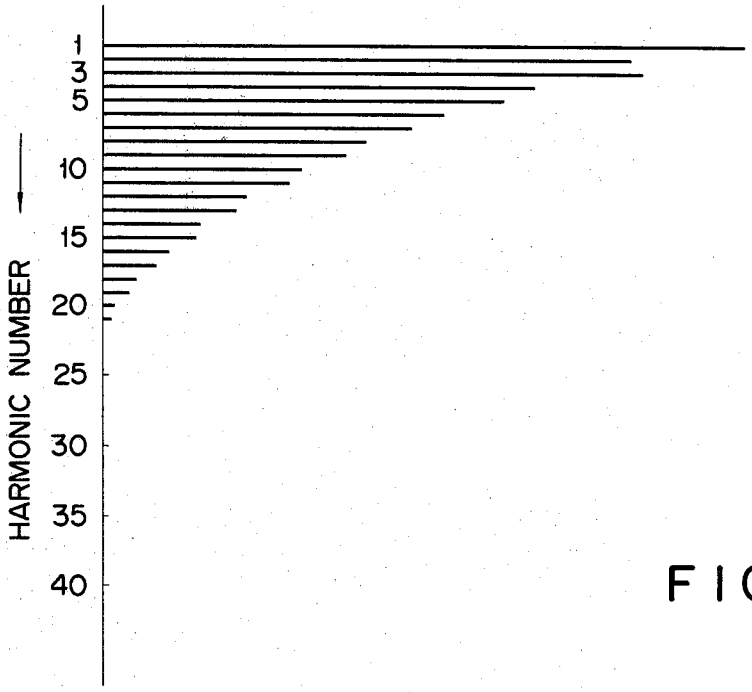

It will be evident from FIGS. 8B, 9B and 10B that the dynamic audio spectra can be realized by varying the modulation index with time.

Figure 11A:
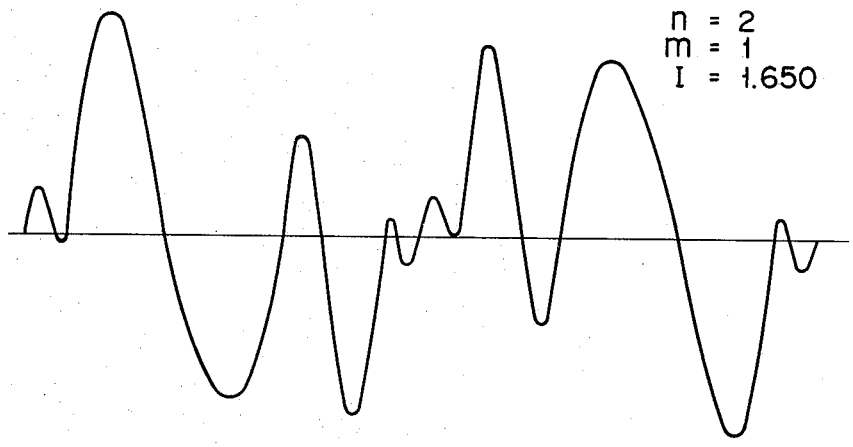
Figure 11B:
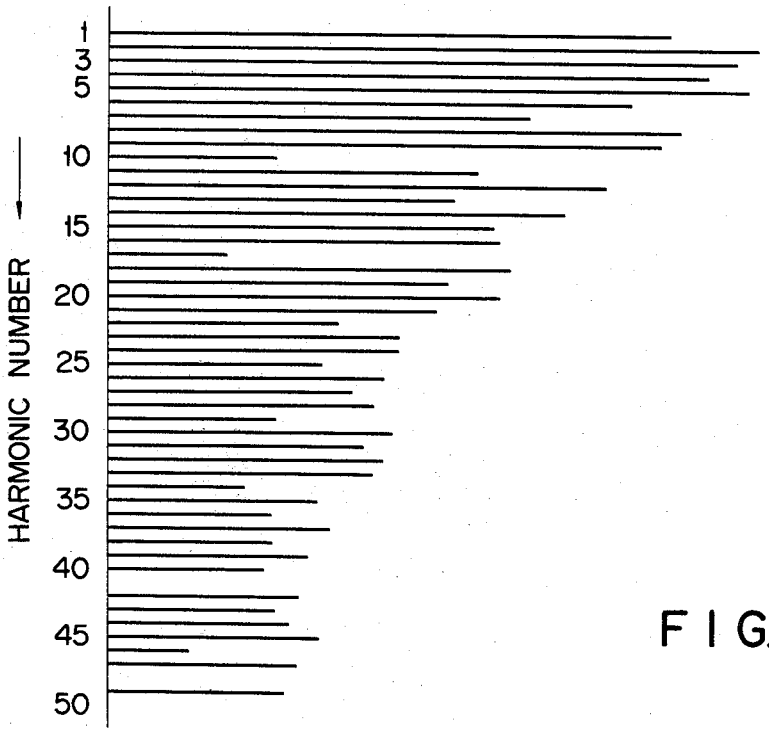

FIG. 11A shows the waveform of a musical tone signal synthesized under a condition m=1, n=2 and I=1.650 and FIG. 11B shows the frequency spectrum of the musical tone signal. This musical tone signal simulates a trumpet-like tone.

Figure 12A:
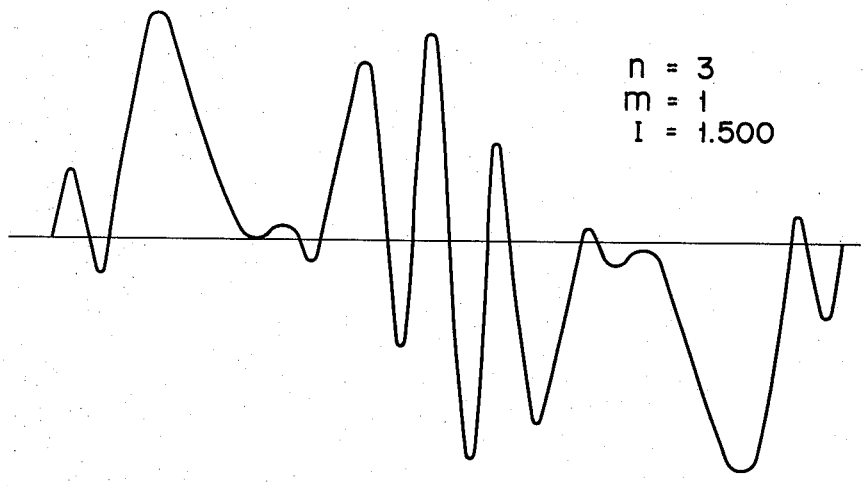
Figure 12B:
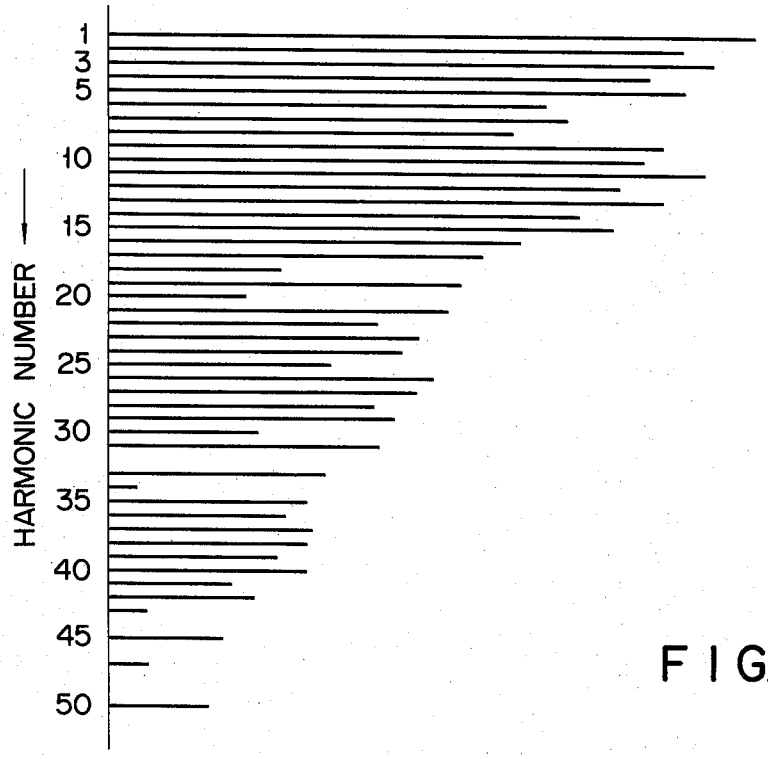

FIG. 12A shows the waveform of a musical tone signal synthesized under a condition n=3, m=1 and I=1.500 and FIG. 12B shows the frequency spectrum of the musical tone signal. This musical tone signal is suited to simulate a violin-like tone.

Figure 13A:
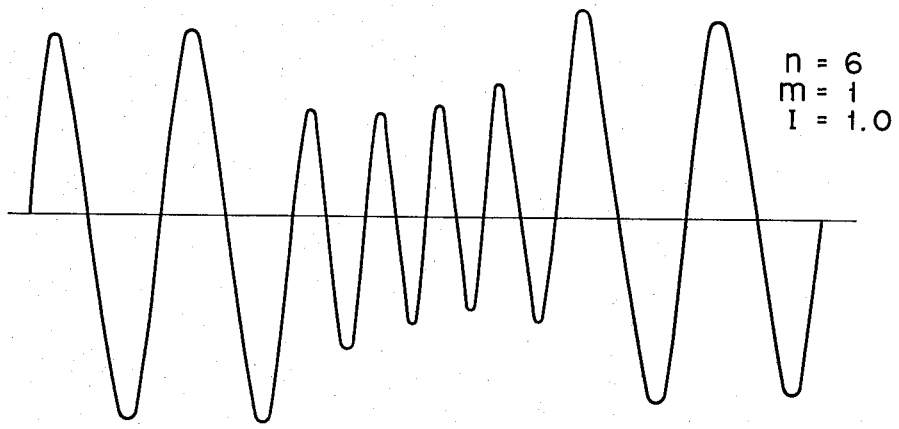
Figure 13B:
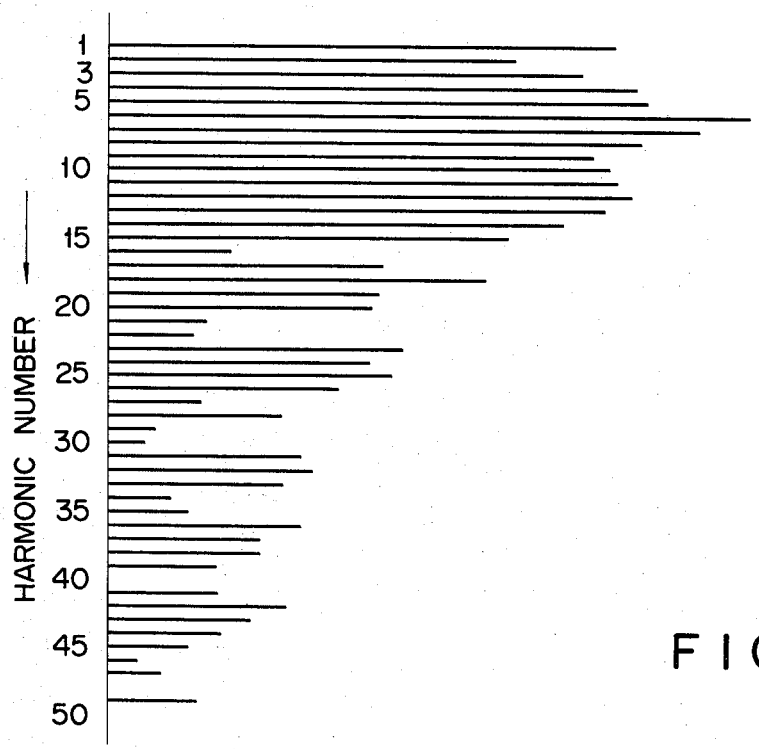
Figure 14:
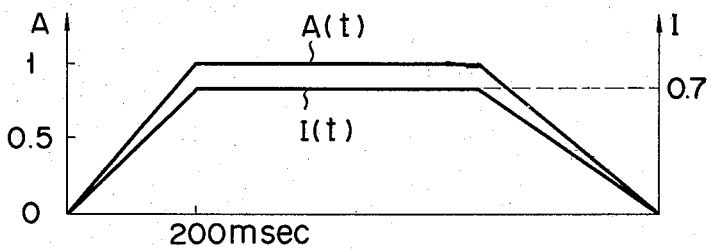
FIGS. 14 through 18 show examples of amplitude functions and modulation index functions which may be used in this invention.
Figure 15:
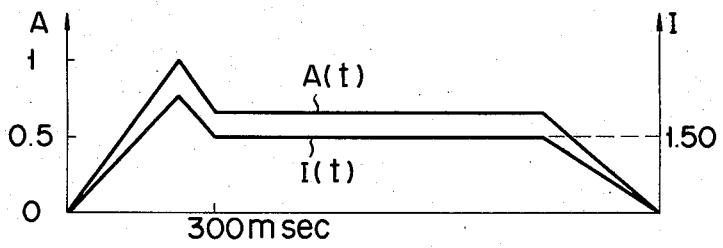
Figure 16:
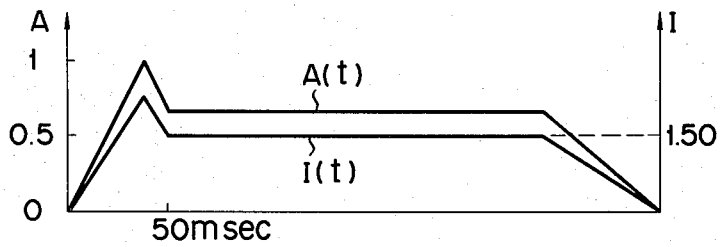
Figure 17:
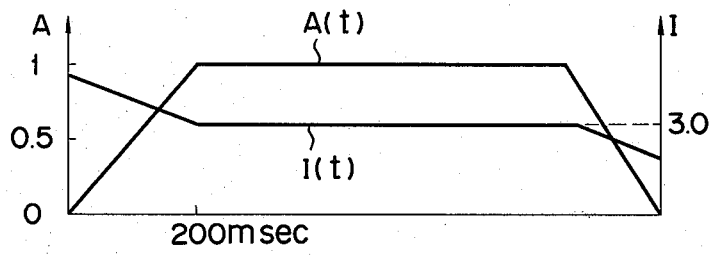
Figure 18:
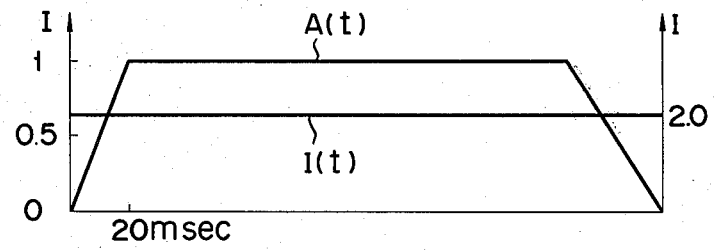

FIGS. 13A and 13B shows the waveform and frequency spectrum of a musical tone signal synthesized under a condition n=6, m=1 and I=1.0, respectively. This musical tone signal is used to simulate an oboe-like tone.

FIGS. 14 to 18 show various combinations of the envelope function A(t) and the modulation index function I(t) which may be used in this invention.

What is claimed is:

1. A method of synthesizing a musical tone comprising the steps of:

periodically producing a fundamental signal which can be represented as a waveform crossing an axis representing zero amplitude, the fundamental signal having first, second and third zero crossing points (i.e., the points at which said waveform crosses said zero amplitude axis) at a phase within one cycle period of the fundamental signal, said first and third zero crossing points being a starting point and a terminating point of the waveform in one cycle period respectively, said second zero crossing point being an intermediate transitional point of the waveform in one cycle period from one side to the other of the zero amplitude axis;

periodically producing a modulation signal; and modulating the phase of said second zero crossing point of said fundamental signal with said modulation signal without modulating the phases of said first and third points to thereby determine the frequency spectrum of the resulting signal to produce a synthesized musical tone.

2. The method according to claim 1 wherein said fundamental signal comprises quadratic functions.

3. The method according to claim 2 wherein said quadratic functions are $(x+1)(x-a)$ and $-(x-1)(x-a)$, where a and x represent said second zero crossing point and a variable, respectively.

4. The method according to claim 2 wherein said quadratic functions are $(x+1)(x-a)(1-a)$ and $-(x-1)(x-a)(1+a)$, where a and x represent said second zero crossing point and a variable, respectively.

5. The method according to claim 1 wherein said modulation signal comprises quadratic functions.

6. The method according to claim 5 wherein said quadratic functions are $u(u+1)$ and $-u(u-1)$, where u represents a variable.

7. The method according to claim 1 wherein said modulation signal is a product of quadratic functions and a modulation index function which is a function of time.

* * * * *